US005901776A

United States Patent [19]

Brückner et al.

[11] Patent Number: 5,901,776

[45] Date of Patent: May 11, 1999

[54] PROCESS FOR THE INDUCTIVE HEATING OF A FIREPROOF MOLDING AND A SUITABLE MOLDING THEREFOR

[75] Inventors: Raimund Brückner, Engenhahn-Niedernhausen; Rüdiger Grau, Grosskrotzenburg; Daniel Grimm, Bad Schwalbach; Seyed Masoud Hashemi; Karl-Heinz Spitzer, both of Clausthal-Zellerfeld, all of Germany

[73] Assignee: Didier-Werke AG, Wiesbaden, Germany

[21] Appl. No.: 08/722,171

[22] PCT Filed: Apr. 4, 1996

[86] PCT No.: PCT/EP96/01477

§ 371 Date: Oct. 10, 1996

§ 102(e) Date: Oct. 10, 1996

[87] PCT Pub. No.: WO96/33829

PCT Pub. Date: Oct. 31, 1996

[30] Foreign Application Priority Data

Apr. 28, 1995 [DE] Germany ..... 195 15 230

[51] Int. Cl.[6] ..... B22D 35/06

[52] U.S. Cl. ..... 164/471; 164/437; 164/493; 222/593

[58] Field of Search ..... 164/428, 480, 164/471, 493, 507, 513, 437, 337; 222/593; 266/236

[56] References Cited

U.S. PATENT DOCUMENTS

| | | | |
|---|---|---|---|
| 3,435,992 | 4/1969 | Tisdale et al. | 164/420 |
| 4,784,209 | 11/1988 | Hlinka et al. | 164/480 |
| 4,940,870 | 7/1990 | Shibata et al. | 219/10.491 |
| 5,156,202 | 10/1992 | Sick et al. | 164/493 |
| 5,198,017 | 3/1993 | Mourer et al. | 75/345 |
| 5,325,906 | 7/1994 | Benz et al. | 164/493 |

FOREIGN PATENT DOCUMENTS

| | | |
|---|---|---|
| 503237 | 9/1992 | European Pat. Off. . |
| 593383 | 4/1994 | European Pat. Off. . |
| 2670697 | 6/1992 | France . |

*Primary Examiner*—Kuang Y. Lin

*Attorney, Agent, or Firm*—Wenderoth, Lind & Ponack, L.L.P.

[57] ABSTRACT

A refractory guide member and a method for heating the refractory guide member by use of an inductor, where at least one collateral electromagnetic field located in a region spaced apart from the inductor is generated by the inductor. The mold part is made of an electrically conductive layer with several insulating interrupting slots for the controlled deflection of eddy currents from a main field generated by the inductor into a region spaced apart from the inductor.

35 Claims, 4 Drawing Sheets

PROCESS FOR THE INDUCTIVE HEATING OF A FIREPROOF MOLDING AND A SUITABLE MOLDING THEREFOR

BACKGROUND OF THE INVENTION

The invention relates to a method for the inductive heating of a refractory mold part or guide member by means of an inductor device. The invention also relates to the corresponding mold part or guide member.

U.S. Pat. No. 3,435,992 discloses a pouring shell for the continuous pouring of liquid metal, in particular steel. The pouring shell is inductively heated before being brought into contact with the liquid metal. The pouring shell described in U.S. Pat. No. 3,435,992 has an electrically conductive insert which is provided in the pouring shell. In addition, the pouring shell is formed of an essentially electrically non-conductive refractory material. Through an induction coil, which encompasses the pouring shell and is essentially disposed coaxially with it, the electrically conductive insert, made of preferably a graphite part, can be heated by a current having a frequency of 3 to 50 kHz. However, only the electrically conductive insert absorbs induction energy and is inductively heated. In contrast, the pouring shell is heated through thermal conduction.

U.S. Pat. No. 4,940,870 teaches of providing an entirely or partially continuous slot within a shell made of an electrically conductive material and encompassed partially by an induction device. The slot, in turn, suppresses the heating of the shell.

FR 2,609,914 discloses a pouring shell with an outer portion that can be heated inductively. Several tubes are set into the outer portion forming the pouring opening. The heat generated by the induction energy is transferred through thermal conduction to the tubes forming the pouring opening.

The disadvantage of the prior art devices described above is that the induction heat is not transferred directly but rather only through thermal conduction to the entire guide member. This is particularly the case when the guide member is not encompassed completely by the inductor device but more or less "projects" from the inductor device.

This is often unavoidable since no other solution is possible for spatial reasons. In such cases the guide member is heated extremely nonuniformly, which can lead to stress fractures and other problems.

SUMMARY OF THE INVENTION

The present invention therefore addresses the problem of the prior art by disclosing an improved and variable method for the inductive heating of a guide member as well as disclosing the corresponding guide member.

The method according to the invention permits the rapid and uniform inductive heating of a molten metal guide member even in regions where inductively generated main electromagnetic field does not extend. An inductor device can thus be placed at a noncritical and constructionally favorable location of the guide member and yet, the entire guide member can be uniformly heated inductively.

In a preferred embodiment of the invention the guide member is a ceramic immersion casting tube for introducing metal melt into a melt sump, in particular into a chill mold for generating thin plate slabs or bands. The immersion casting tube projects into the chill mold. When the chill mold is filled, the immersion casting tube is immersed with its lower region in the metal sump covered with casting powder.

The danger of bridge formation between the immersion casting tube and the chill mold wall, especially with thin plate slabs and immersion casting tubes, can be avoided through the capability of heating the immersion casting tube in the region encompassed by the chill mold by an inductor device disposed above the chill mold. Moreover, the casting powder can be melted thus improving the reproducibility of the method or the quality of the product. At the same time, the danger of clogging is decreased.

In another preferred embodiment of the invention the guide member is a ceramic feed channel for placing metal melt onto a conveying belt.

A guide member according to the invention, which is used in particular for introducing or placing metal melt, has an electrically conductive layer provided in a longitudinal direction with a continuous non-interrupted electrically insulating longitudinal slot. The electrically insulating longitudinal slot is advantageously filled with an electrically insulating refractory ceramic material. The inner region encompassed by the guide member, through which the metal melt is introduced or fed, is provided with an electrically insulating, refractory, ceramic inner layer facing the metal melt. The remaining regions of the guide member, which during use are either immersed in the melt sump or when feeding the metal melt to a cooled conveyor belt come into contact with the metal melt, are provided with an electrically insulating, refractory ceramic layer. To generate a collateral electromagnetic field, or in other words, a field located away from a main field generating inductor, a guide member according to the invention has, in an intermediate region, an electrically insulating longitudinal slot. This longitudinal slot connects at least two electrically insulating transverse slots extending in the intermediate region nearly around the entire circumference of the guide member, and deflects a main electromagnetic field thus generating the collateral electromagnetic field. With this configuration, eddy currents are diverted and in addition to a main electromagnetic field, a collateral electromagnetic field is formed which ensures the uniform heating of the guide member.

In yet another preferred embodiment of the invention, the guide member is divided in a longitudinal direction by an electrically insulated dividing wall. The dividing wall can be anchored in a continuous electrically insulating longitudinal slot and electrically insulating longitudinal slot(s) in the intermediate region. This dividing wall can for example also be implemented as a flow divider in an immersion casting tube or it can increase the mechanical stability of the immersion casting tube or a feed channel.

In still another preferred embodiment of the invention, the guide member is a lateral limiter plate such as is required in particular for a device for the continuous casting of metal melt between casting rollers, a so-called twin-roll caster. The use of a guide member according to the invention in this case permits not having to mount the inductor device directly adjacent the rollers while still avoiding a premature solidification of metal melt in the wedge-like area located between the casting rollers. Such guide member has an open top end with limiter plates located laterally of the rollers and extending in a longitudinal direction.

The following features characterize the guide member according to the invention.

The guide member is composed of an electrically conductive layer. On the side facing the metal melt, an electrically insulating layer is provided. The intermediate region has at least one electrically insulating longitudinal slot which connects at least two transverse slots extending across this intermediate region nearly over the entire width of the guide member, thus interrupting the electromagnetic field. Such embodiment of the guide member deflects eddy currents from a main field, generated by an inductor, thus creating a collateral electromagnetic field which, in turn, inductively heats a region spaced apart from the inductor.

In yet another embodiment of the invention, the slots are longitudinal slots crossing in the intermediate region and deflect eddy currents from a main field, generated by an inductor, thus again creating a collateral electromagnetic field or fields in a region spaced apart from the inductor.

In a particular embodiment of the invention the electrically conductive materials have a specific electrical resistance which is less than 1000 Ohm $mm^2/m$, preferably 200 Ohms $mm^2/m$. It was found experimentally that such materials have good coupling behavior. Especially good results were obtained with a carbon-bound graphite containing aluminum oxide material. The electrically insulating slots and the electrically insulating inner and/or outer layer are preferably made from suitable electrically nonconductive refractory materials, such as for example zirconium oxide.

BRIEF DESCRIPTION OF THE DRAWINGS

Further advantageous embodiments of the invention can be found in the dependent claims and as are evident in the embodiment examples explained in the following in further detail in conjunction with the drawings.

In the drawings.

DETAILED DESCRIPTION OF THE INVENTION

Figure 1:
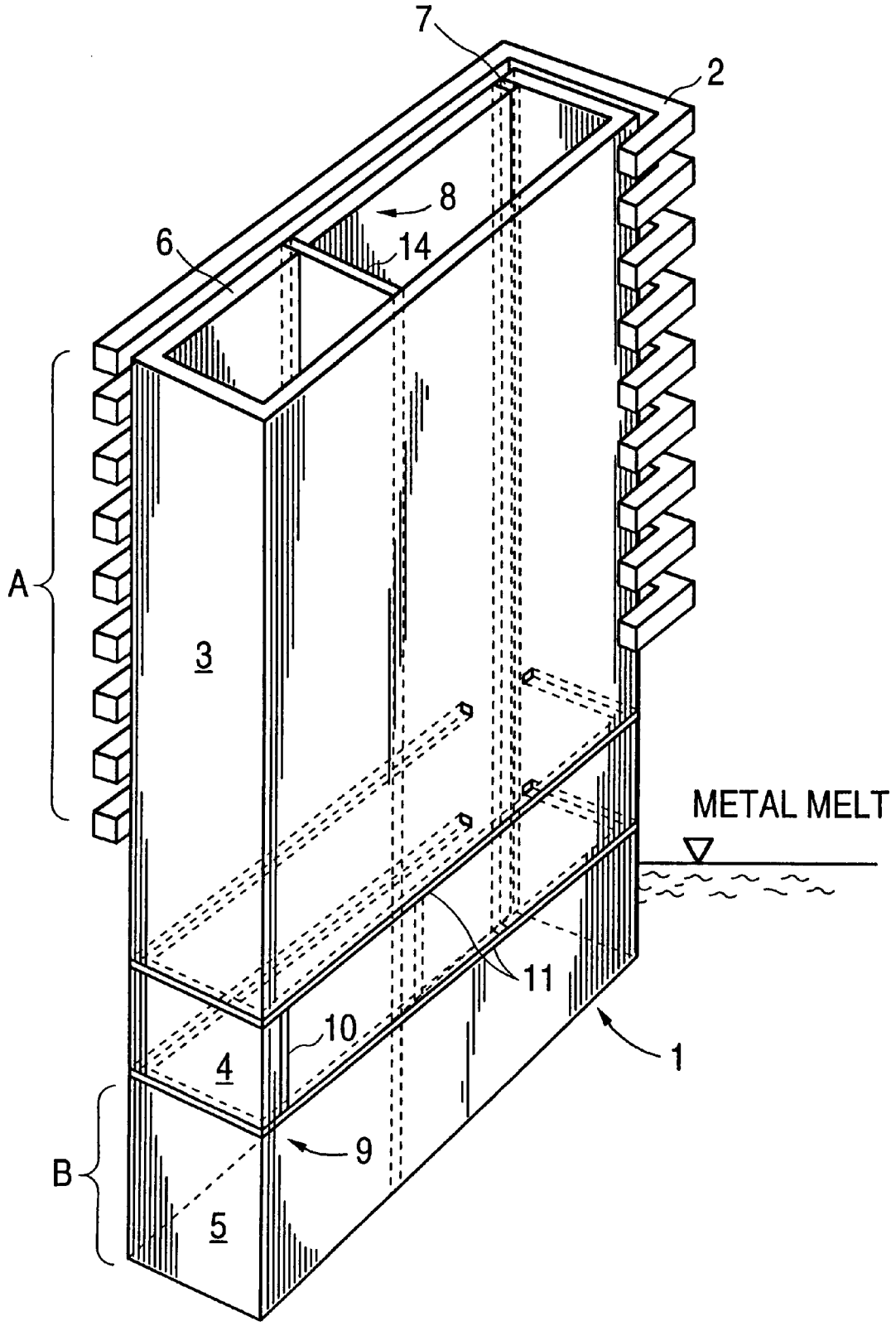
FIG. 1 depicts a guide member with a rectangular cross section including an inductor device.

FIG. 1 shows a guide member (1), for example a refractory ceramic immersion casting tube for the introduction of metal melt into a chill mold or a refractory ceramic feed channel for placing metal melt onto a conveyor belt. In region (3) the guide member (1) is encompassed by an inductor device (2) which generates a main electromagnetic field (A). A collateral electromagnetic field (B) is generated in two regions (4 and 5) of the guide member (1), which is essentially built of an electrically conductive layer, by providing a continuous electrically insulating longitudinal slot (7) in a longitudinal direction and by providing slots (10, 11) in the intermediate region (4).

The electrically insulating transverse slots (11) extend in the intermediate region (4), nearly around the entire circumference of the guide member (1), and are connected to each other by another electrically insulating longitudinal slot (10). Through this implementation of the guide member (1), a collateral electromagnetic field (B) is generated by the inductor device (2) in regions (4, 5) thus inductively heating the guide member in a region spaced apart from the inductor (1). In order to avoid the coupling of the metal melt, which is undesirable in this case, the guide member (1), which is essentially composed of an electrically conductive layer (6), is provided with electrically insulating layers (8, 9) on surfaces in contact with metal melt. These electrically insulating layers enclose the front faces of the guide member (1) in all areas which may come in contact with the metal melt. The electrically insulating inner layer (8) extends over all inside surfaces of the guide member (1). The electrically insulating outer layer (9) extends at least over the surface of the metal sump shown schematically. The slots (7, 10, 11) are filled with an electrically insulating ceramic material. In addition, guide member (1) may be divided in the longitudinal direction by an electrically insulated dividing wall (14).

Figure 2:
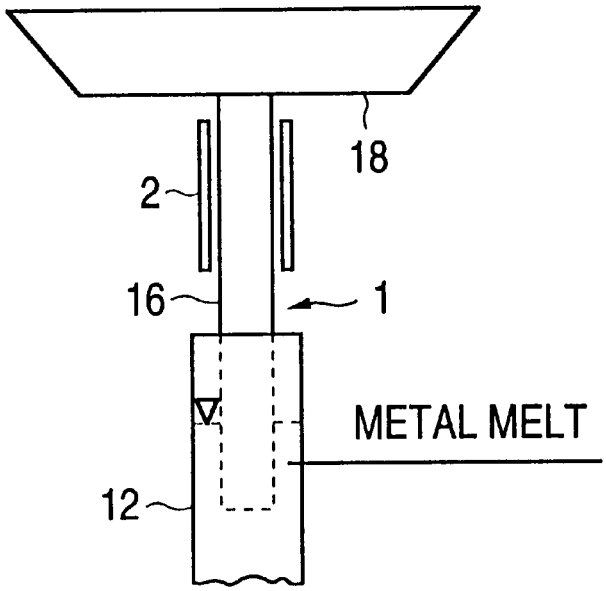
FIG. 2 depicts, schematically, an immersion casting tube which introduces metal melt from a distributor vessel into a chill mold.

FIG. 2 shows a guide member (1) used as an immersion casting tube (16). From a distributor vessel (18), metal melt is introduced into a chill mold (12) by a guide member (1) implemented as immersion casting tube (16). The guide member (1) is heated inductively via an inductor device (2) shown schematically. According to the invention, the guide member (1) can be heated in a region located in the melt sump. Apart from the lesser thermal shock sensitivity brought about during the casting, the danger of bridge formations which exist in particular during thin slab plate casting is also reduced. In addition, the guide member (1) in the region located in the metal sump during the casting process is inductively heated.

Figure 3:
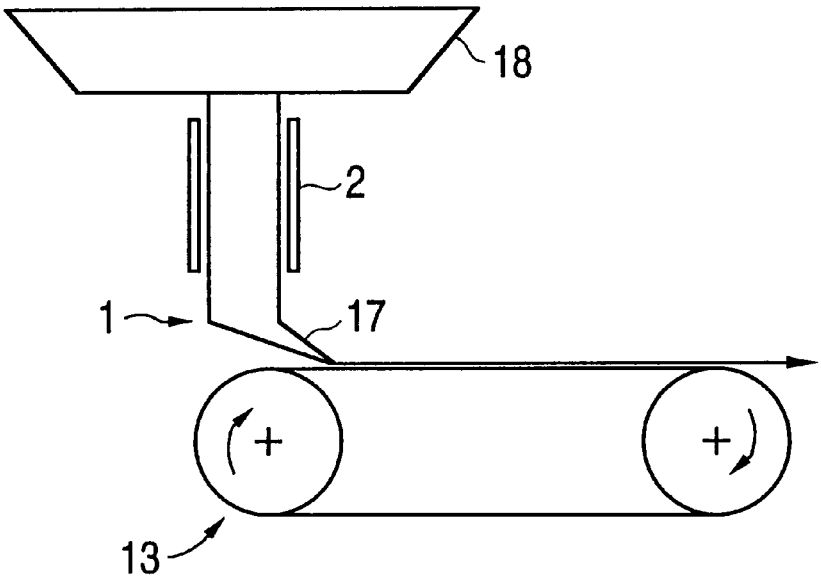
FIG. 3 depicts, schematically, a feed channel through which metal melt from a distributor vessel is placed onto a conveyor device.

FIG. 3 shows an arrangement somewhat similar to FIG. 2, where the metal melt is not fed into a chill mold but rather is placed onto a conveyor device (13). In this case, the guide member (1), implemented as feed channel (17), is not or is only to a very small degree, immersed in the metal melt. Accordingly, the electrically insulating outer layer (9), can be narrower.

Figure 4A:
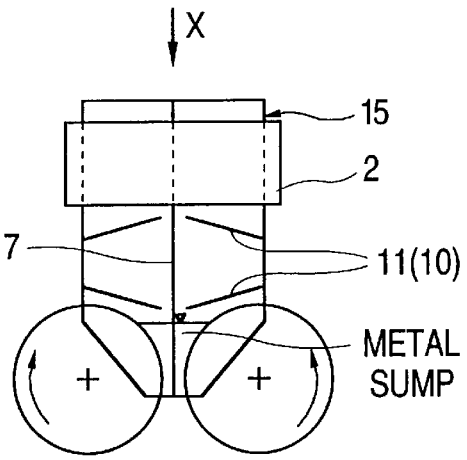
FIG. 4*a* depicts a front view of a lateral limiter plate on a twin-roll caster.
Figure 4B:
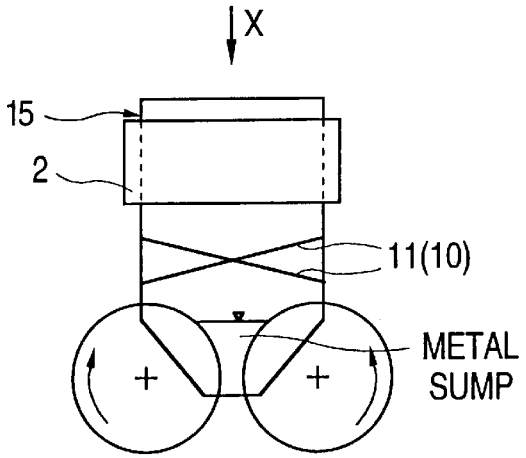
FIG. 4*b* depicts a rear view of a lateral limiter plate on a twin-roll caster.

In FIGS. 4*a* and 4*b* a twin-roll caster, with a limiter plate (15) acting as a lateral boundary for the metal melt, is shown schematically. By means of an inductor device (2) and electrically insulating slots (7, 11), the limiter plate (15) can also be heated inductively in a lower region. With this arrangement, the undesirable solidification of the metal melt in the wedge-like area located between the casting rollers and the limiter plates, which leads to the destruction of the casting rollers or a poor band quality, is avoided.

Figure 5:
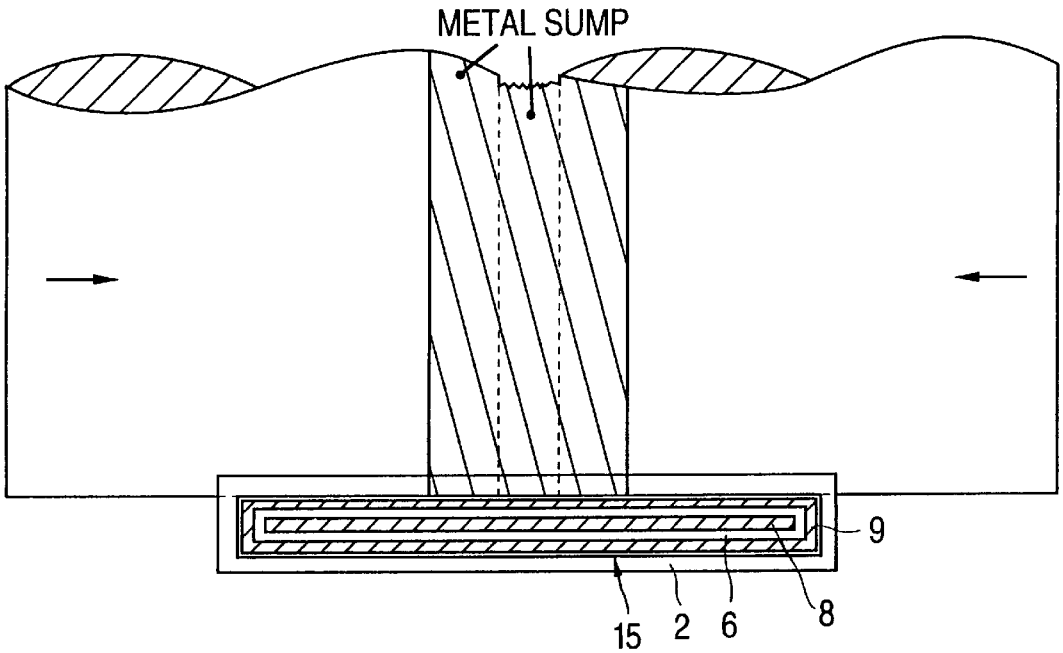
FIG. 5 depicts a partial top view of FIG. 4 in a direction X.

FIG. 5 shows a limiter plate (15) according to the invention which comprises essentially an electrically conductive slot layer (6) as well as an electrically insulating inner layer (8). The entire plate is preferably enveloped by an electrically insulating layer (9).

Figure 6:
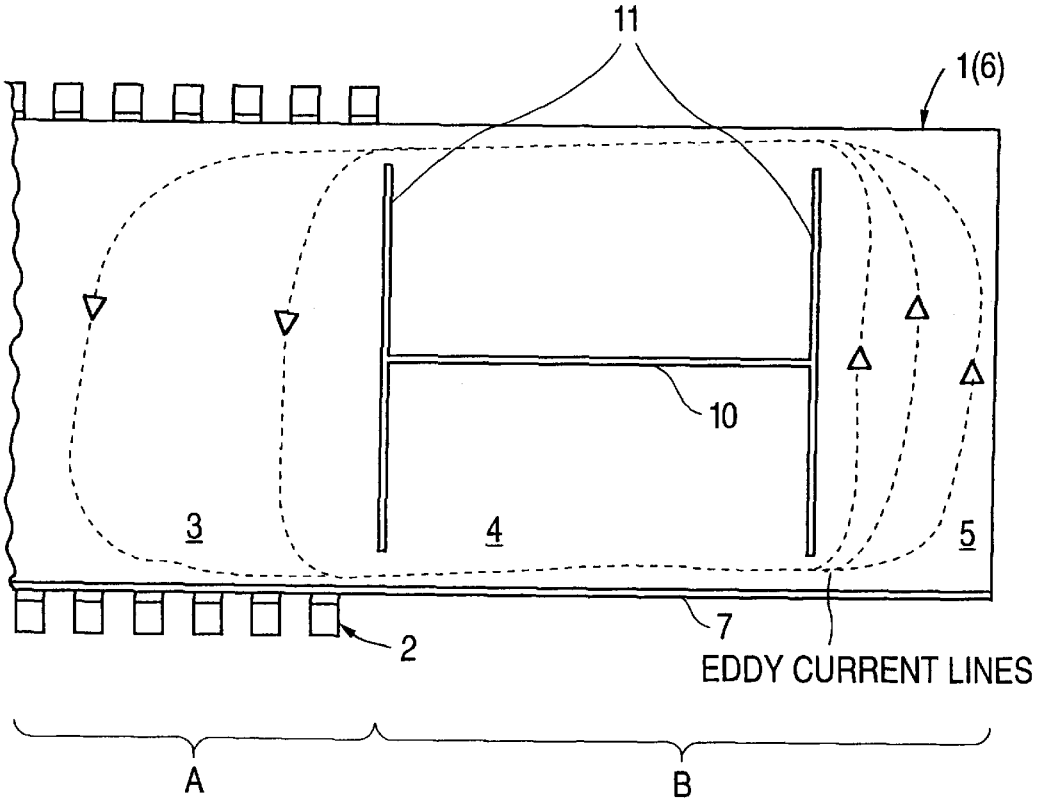
FIG. 6 depicts the development of eddy current lines of an electrically conductive layer according to FIG. 1.

FIG. 6 shows the development of the eddy current lines of the guide member (1) depicted in FIG. 1. As shown, the electrically conductive layer (6) is interrupted by the electrically insulating longitudinal and transverse slots (10 and 11). The inductor device (2) generates a main filed in the region (3). Additionally, through the arrangement of the slots in the intermediate region (4), eddy currents are deflected from the main field into region (5) thus creating a collateral electromagnetic field which inductively heats a region spaced apart from the inductor.

We claim:

1. A method of inductively heating an electrically conductive guide member employed to guide molten metal, said method comprising:

employing an inductor to generate a main field in a first region of said electrically conductive guide member, thereby inductively heating said first region and producing eddy currents; and diverting at least a part of said eddy currents from said first region of said electrically conductive guide member to a second region thereof, that is not acted upon by said main field, by electrically non-conductive interruptions in said electrically conductive guide member including at least one electrically non-conductive interruption positioned between said first region and said second region, thereby inductively heating said second region;

wherein said electrically conductive guide member has an inner surface, an outer surface, and an electrically insulating slot which extends continuously in a longitudinal direction;

wherein said inner surface has an electrically insulating surface formed thereon;

wherein said outer surface of at least said second region has an electrically insulating surface formed thereon; and wherein said electrically non-conductive interruptions are comprised of at least two electrically insulating transverse slots formed in said electrically conductive guide member which extend around nearly an entire circumference of said electrically conductive guide member, and at least one electrically insulating longitudinal slot connecting said at least two electrically insulating transverse slots.

2. The method of claim 1, wherein:

said electrically conductive guide member is a ceramic immersion casting tube introducing molten metal into a mold.

3. The method of claim 1, wherein:

said electrically conductive guide member is a ceramic feed channel placing molten metal onto a conveyor device.

4. The method of claim 1, wherein:

said electrically conductive guide member has a specific electrical resistance of less than 1000 Ohm $mm^2/m$.

5. The method of claim 1, wherein:

said electrically conductive guide member has a specific electrical resistance of less than 200 Ohm $mm^2/m$.

6. The method of claim 1, wherein:

said electrically conductive guide member is composed of a carbon-containing refractory material.

7. The method of claim 1, wherein:

said electrically conductive guide member is composed of a carbon-bound graphite containing $Al_2O_3$.

8. The method of claim 1, further comprising:

inserting an electrically insulated dividing wall longitudinally within said electrically conductive guide member.

9. The method of claim 1, wherein:

said at least one electrically insulating longitudinal slot is located in a third region interposed between said first and said second regions.

10. The method of claim 1, wherein:

said electrically insulating layer of said inner surface and said electrically insulating layer of said outer surface are composed of an electrically non-conductive refractory material.

11. The method of claim 1, wherein:

said electrically insulating layer of said inner surface and said electrically insulating layer of said outer surface are composed of $ZrO_2$.

12. An electrically conductive guide member that is to be inductively heated while being employed to guide molten metal, said electrically conductive guide member comprising:

a first region to be inductively heated by the generation therein of a main field by an inductor;

a second region not to be acted upon by said main field; and electrically non-conductive interruptions located in said electrically conductive guide member including at least one electrically non-conductive interruption positioned between said first region and said second region to divert at least a part of eddy currents produced by said main field from said first region to said second region and thereby to inductively heat said second region;

wherein said electrically conductive guide member has an inner surface, an outer surface, and an electrically insulating slot which extends continuously in a longitudinal direction;

wherein said inner surface has an electrically insulating surface formed thereon; wherein said outer surface of at least said second region has an electrically insulating surface formed thereon; and wherein said electrically non-conductive interruptions are comprised of at least two electrically insulating transverse slots formed in said electrically conductive guide member which extend across said electrically conductive guide member, and at least one electrically insulating longitudinal slot connecting said at least two electrically insulating transverse slots.

13. The electrically conductive guide member of claim 12, wherein:

said electrically conductive guide member is a ceramic immersion casting tube capable of introducing molten metal melt a mold.

14. The electrically conductive guide member of claim 12, wherein:

said electrically conductive guide member is a ceramic feed channel capable of placing molten metal onto a conveyor device.

15. The electrically conductive guide member of claim 12, wherein:

said electrically conductive guide member has a specific electrical resistance of less than 1000 Ohm $mm^2/m$.

16. The electrically conductive guide member of claim 12, wherein:

said electrically conductive guide member has a specific electrical resistance of less than 200 Ohm $mm^2/m$.

17. The electrically conductive guide member of claim 12, wherein:

said electrically conductive guide member is composed of a carbon-containing refractory material.

18. The electrically conductive guide member of claim 12, wherein:

said electrically conductive guide member is composed of a carbon-bound graphite containing $Al_2O_3$.

19. The electrically conductive guide member of claim 12, wherein:

said at least two electrically insulating transverse slots extend around nearly an entire circumference of said electrically conductive guide member.

20. The electrically conductive guide member of claim 12, wherein:

an electrically insulated dividing wall is longitudinally provided within said electrically conductive guide member.

21. The electrically conductive guide member of claim 12, wherein:

said at least one electrically insulating longitudinal slot is located in a third region interposed between said first and said second regions.

22. The electrically conductive guide member of claim 12, wherein:

said electrically insulating layer of said inner surface and said electrically insulating layer of said outer surface are composed of an electrically non-conductive refractory material.

23. The electrically conductive guide member of claim 12, wherein:

said electrically insulating layer of said inner surface and said electrically insulating layer of said outer surface are composed of $ZrO_2$.

24. An assembly, comprising:

a electrically conductive guide member to be employed to guide molten metal, said electrically conductive guide member including a first region, a second region and electrically non-conductive interruptions including at least one electrically non-conductive interruption positioned between said first region and said second region;

an inductor positioned to generate a main field acting on said first region, thereby to inductively heat said first region and to produce eddy currents, and not acting on said second region; and wherein said electrically non-conductive interruptions are located to divert at least a part of said eddy currents from said first region to said second region, thereby to inductively heat said second region;

wherein said electrically conductive guide member has an inner surface, an outer surface, and an electrically insulating slot which extends continuously in a longitudinal direction;

wherein said inner surface has an electrically insulating surface formed thereon;

wherein said outer surface of at least said second region has an electrically insulating surface formed thereon; and wherein said electrically non-conductive interruptions are comprised of at least two electrically insulating transverse slots formed in said electrically conductive guide member which extend across said electrically conductive guide member, and at least one electrically insulating longitudinal slot connecting said at least two electrically insulating transverse slots.

25. The assembly of claim 24, wherein:

said electrically conductive guide member is a ceramic immersion casting tube capable of introducing molten metal into a mold.

26. The assembly of claim 24, wherein:

said electrically conductive guide member is a ceramic feed channel capable of placing molten metal onto a conveyor device.

27. The assembly of claim 24, wherein:

said electrically conductive guide member has a specific electrical resistance of less than 1000 Ohm $mm^2/m$.

28. The assembly of claim 24, wherein:

said electrically conductive guide member has a specific electrical resistance of less than 200 Ohm $mm^2/m$.

29. The assembly of claim 24, wherein:

said electrically conductive guide member is composed of a carbon-containing refractory material.

30. The assembly of claim 24, wherein:

said electrically conductive guide member is composed of a carbon-bound graphite containing $Al_2O_3$.

31. The assembly of claim 24, wherein:

said at least two electrically insulating transverse slots extend around nearly an entire circumference of said electrically conductive guide member.

32. The assembly of claim 24, wherein:

an electrically insulated dividing wall is longitudinally provided within said electrically conductive guide member.

33. The assembly of claim 24, wherein:

said at least one electrically insulating longitudinal slot is located in a third region interposed between said first and said second regions.

34. The assembly of claim 24, wherein:

said electrically insulating layer of said inner surface and said electrically insulating layer of said outer surface are composed of an electrically non-conductive refractory material.

35. The assembly of claim 24, wherein:

said electrically insulating layer of said inner surface and said electrically insulating layer of said outer surface are composed of $ZrO_2$.

* * * * *